United States Patent [19]

Hatch

[11] 4,127,951

[45] Dec. 5, 1978

[54] AUTOMATIC COUPLING MECHANISM FOR SNOW-PLOWS AND THE LIKE

[76] Inventor: Richard W. Hatch, Rte. #2, Box 31A, Milaca, Minn. 56353

[21] Appl. No.: 811,591

[22] Filed: Jun. 30, 1977

[51] Int. Cl.[2] ..... E01H 5/04

[52] U.S. Cl. ..... 37/44; 172/272; 172/398

[58] Field of Search ..... 37/41, 42 R, 42 VL, 37/44, 46, 50; 172/272-276, 395-398, 439, 444, 448

[56] References Cited

U.S. PATENT DOCUMENTS

| | | | |
|---|---|---|---|
| 2,651,121 | 9/1953 | Shannon | 37/42 R |
| 2,710,464 | 6/1955 | Husting | 37/42 R |
| 3,020,066 | 2/1962 | Torrey | 37/42 R X |
| 3,150,884 | 9/1964 | Drott | 37/42 R X |
| 3,285,625 | 11/1966 | Krueger | 37/42 R |
| 3,343,850 | 9/1967 | Stauss et al. | 37/41 X |
| 3,376,946 | 4/1968 | Paulson | 37/42 R X |
| 3,432,949 | 3/1969 | Glesmann | 37/42 VL |
| 3,483,641 | 12/1969 | Hirt | 37/44 |
| 3,760,883 | 9/1973 | Birk | 37/41 |
| 3,952,431 | 4/1976 | Gledhill et al. | 37/41 |

FOREIGN PATENT DOCUMENTS

| | | | |
|---|---|---|---|
| 1249305 | 9/1967 | Fed. Rep. of Germany | 37/41 |
| 1564144 | 4/1969 | France | 37/42 R |

*Primary Examiner*—E. H. Eickholt

*Attorney, Agent, or Firm*—Schroeder, Siegfried, Ryan, Vidas & Steffey

[57] ABSTRACT

Disclosed is an automatic coupling mechanism for snow-plows and the like, provided by a first frame means which is attachable to a propelling vehicle for cooperating with a frame structure of a snow-plow for moving the plow along the road. A second frame means is provided for lockably connecting with the first frame means. Guide means are provided for guiding the first frame means into lockable relative position with the second frame means. Securing means carried by one of the frame means are provided for locking the first and second frame means together when in a lockable position such that as to prevent relative horizontal and vertical motion between the first and second frame means when locked together. Pivotal support means are provided at both the second frame means and the plow frame structure for supporting the plow, allowing free relative vertical movement of the plow with respect to the first and second frame means and controlling orientation of the plow relative to the second frame means. In addition, the mechanism may be provided with lifting means carried by the two frame means for causing the plow to be raised and held above the road a desired amount.

8 Claims, 5 Drawing Figures

AUTOMATIC COUPLING MECHANISM FOR SNOW-PLOWS AND THE LIKE

BACKGROUND OF THE INVENTION

This invention relates to an automatic coupling mechanism and, more particularly, to an automatic coupling mechanism for coupling a propelling vehicle to a snow-plow and the like and for supporting the plow and for allowing free vertical movement of the plow with respect to the road surface as the plow is propelled by the vehicle along the road.

The prior art contains many structures for coupling a propelling vehicle to a snow-plow and for supporting such plow with respect to the road surface. However, such prior art structures are plagued by a number of disadvantages. One of the serious disadvantages of such prior art structures is that the structure which is used for supporting the plow must be attached to the main frame and, in addition, in some cases, the axle of the propelling vehicle. In addition, such prior art structures, although providing sufficient stability for supporting and carrying the plow, do not allow a free vertical movement of the plow with respect to the supporting structure in accordance with the undulations and unevenness of the road as the plow is propelled by the vehicle along the road. Often the plow is not rigidly and stably supported by the structure. Some prior art mechanisms provide the vertical movement of the plow by transverse or vertical motion of a pin located in a vertically elongated slot arrangement such as that shown in the Husting U.S. Pat. No. 2,710,464. In this particular prior art structure, the plow frame structure must be connected to the main structure or frame of the propelling vehicle, as well as coupled to the axle of the vehicle. In addition, great stress and wear occur to the structure where the pin rides in the elongated slot which allows for limited vertical movement of the plow with respect to the frame structure. Also the Husting structure requires that the plow support bars be rigidly welded between the frame structure and the plow or plow frame structure. Therefore, the only vertical motion allowed the plow is provided by the pin and slot arrangement which has a tendency to rapidly wear and deteriorate because of the heavy mass of the plow and plow frame support.

The advantages of the present invention are to provide the combination of a very stable and rigid support for the plow while at the same time allowing as free a floating motion as possible for the plow in a vertical direction with respect to the supporting structure as the vehicle propels the plow along the road. In addition, the present invention does not require that the supporting structure for the plow be in any way attached to the axle or other frame portion of the propelling vehicle. The coupling mechanism of the present invention allows a very rapid connection and disconnection of the plow to the propelling vehicle with a minimal effort on the part of the operator. And most importantly, the structure of the present invention allows the greatest possible floating action of the plow with respect to the undulations and unevenness of the road and free movement with respect to the support structure, while at the same time providing a very rigid and unyielding frame structure for supporting the weight of the plow. The coupling mechanism of the present invention provides the plow with a very free ability to rise and fall witha the surface of the road while simultaneously maintaining and controlling the orientation of the plow with respect to the supporting structure.

SUMMARY OF THE INVENTION

An automatic coupling mechanism for snow-plows and the like comprising: first frame means attachable to a propelling vehicle for cooperating with a plow frame structure of such a snow-plow for movement of the plow along the road. A second frame means is provided and is constructed and arranged to be connected to the plow frame structure for lockably connecting with the first frame means. Guide means are attached to one frame means for guiding the first frame means into lockable relative position with the second frame means. Securing means carried by one of the frame means are provided for locking the two frame means together so as to prevent relative horizontal and vertical motion between the two frame means when locked together. Pivotal support means are provided to be pivotally connected in supporting relation at both the second frame means and the plow frame structure for supporting a plow, allowing free relative vertical movement of the plow with respect to the two frame means and controlling orientation of the plow relative to the second frame means. In addition, lifting means carried by the two frame means are provided for allowing the plow to be raised and held above the road a desired amount.

These and other features and advantages of the present invention will more fully appear from the following description made in connection with the accompanying drawings, wherein like reference characters refer to similar parts throughout the several views.

DETAILED DESCRIPTION

Figure 1:
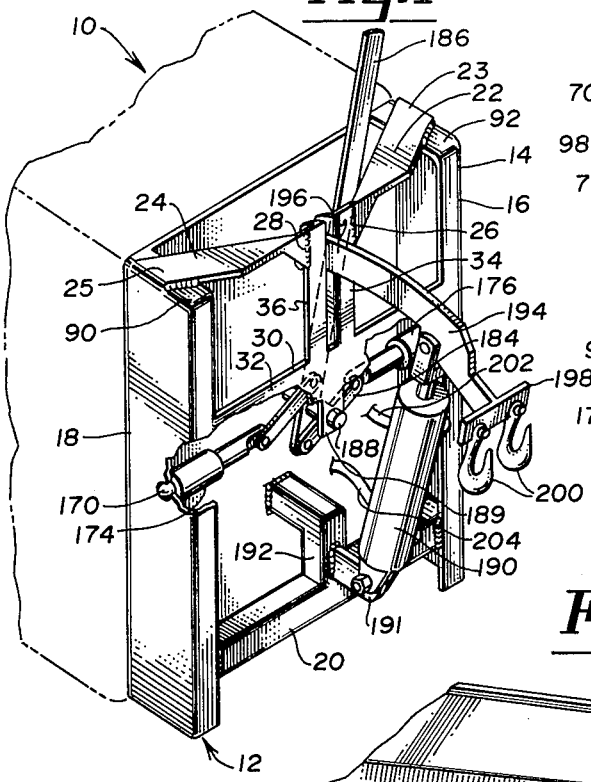
FIG. 1 is a partially cutaway perspective view of a first frame means attachable to the propelling vehicle.

FIG. 1 shows the front end of a propelling vehicle 10 to which is attached a first frame structure 12. Frame structure 12 includes a rectangular frame 14 which is attached by any one of a number of conventional means to the front end of propelling vehicle 10. Frame 14 is comprised of vertical sides 16 and 18. The rectangular frame 14 has a lower horizontally positioned side member 20. The side member 20 is connected between the bottom portions of sides 16 and 18. The top portions of sides 16 and 18 are connected by supports 22 and 24 each of which has one end 23 and 25 respectively connected or fixed to the top of sides 16 and 18 respectively and the other ends of which are connected at 26 and 28 respectively to a T-bar 30 having a horizontal cross piece 32 which is fixed to sides 16 and 18 and two spaced-apart vertically extending sections 34 and 36. Support 22 is fixed to the top end of vertical support 34 at 26 while support 24 is fixed at 28 to the vertical support 36 of T-bar 30.

Figure 2:
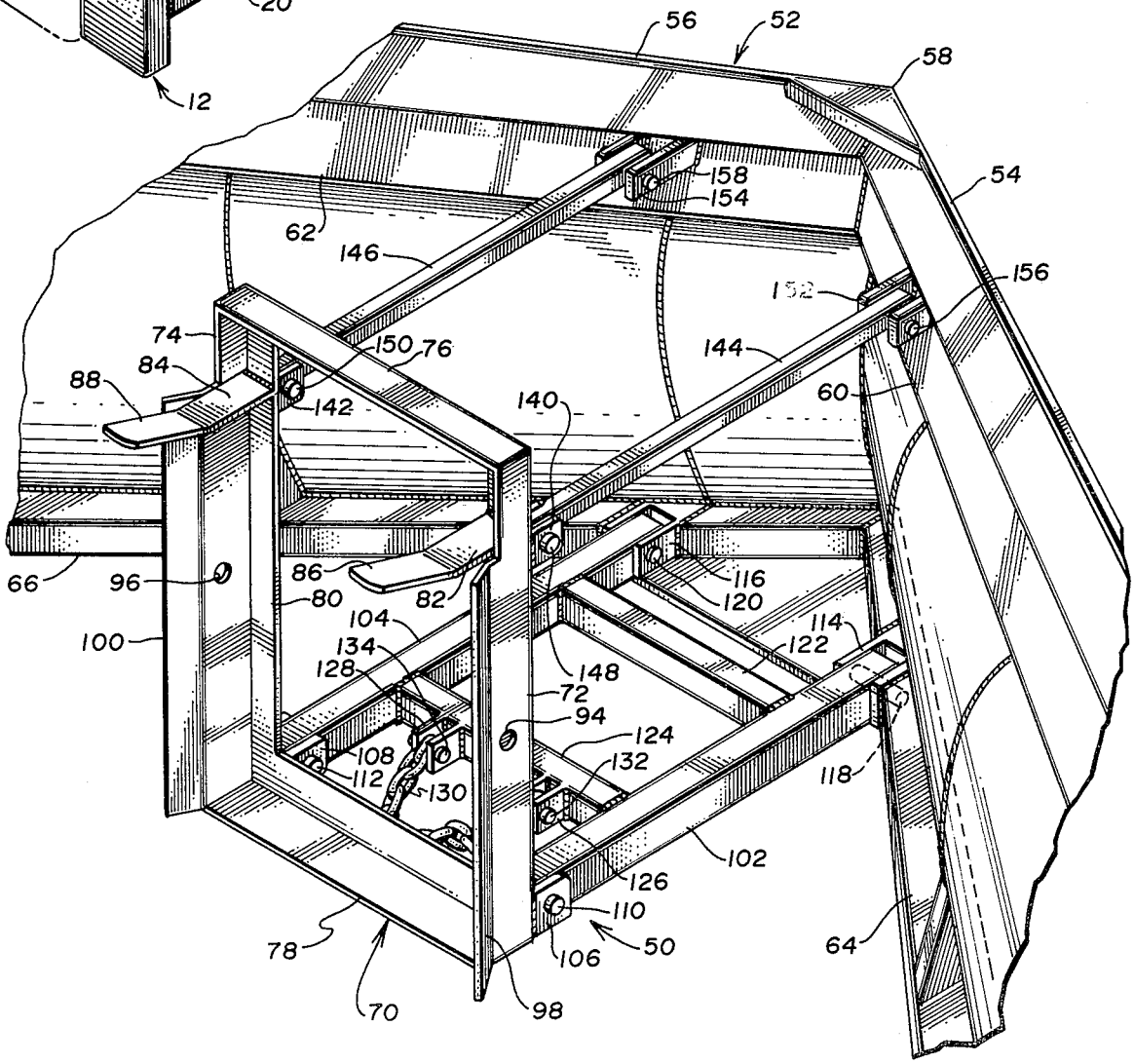
FIG. 2 is a perspective view of a second frame means for supporting and controlling movement of the plow with respect to that frame means.

FIG. 2 shows a frame structure 50 for supporting a nose-shaped snow-plow 52. Plow 52 has blade portions 54 and 56 which come together to form a nose 58. Plow 52 has a frame structure for attaching plow 52 to the plow support frame structure 50. Plow 52 has two upper substantially horizontally disposed frame members 60 and 62 which are mounted to the upper portions and on the back side of blade portions 54 and 56 respectively. There are also lower frame members 64 and 66 which are disposed on the back side and near the bottom of blade portions 54 and 56 respectively. Frame members 60 and 64 are located substantially parallel to one another, as are frame members 62 and 66.

Plow support frame structure 50 includes a rectangular frame 70 having vertical sides 72 and 74 and horizontal sides 76 and 78 respectively. Horizontal side 76 connects the upper portions of vertical sides 72 and 74 while horizontal side 78 connects the lower portions of vertical sides 72 and 74 respectively. Fixed to the edges of rectangular frame 70 closest to plow 52 is a rectangular plate 80. Fixed near the upper portion of rectangular plate 80 and to the upper inside portions of sides 72 and 74 are camming members 82 and 84 which extend generally in a direction away from plow 52. Ends 86 and 88 respectively of camming members 82 and 84 respectively are flared upwardly for engagement with the top portions of vertically disposed sides 16 and 18 of frame 12. Specifically, members 86 and 88 are adapted to engage sides 16 and 18 at points 90 and 92 respectively when frame 12 is moved toward frame 70 and help guide frame 12 vertically into locked connection with frame 70 as will be explained below. Vertical sides 72 and 74 of frame 70 have opposing holes 94 and 96 respectively passing therethrough for engagement by locking pins which are carried by frame 12. Vertical sides 72 and 74 have outwardly flared portions 98 and 100 respectively which help guide frame 12 horizontally into nestable engagement with rectangular frame 70 as will hereinafter be explained.

Plow support frame structure 50 also includes a pair of supporting pusher bars 102 and 104 respectively. Rectangular plate 80, at the bottom thereof and adjacent vertical sides 72 and 74 of rectangular frame 70, has brackets 106 and 108 fixed thereto for pivotally connecting supporting pusher bars 102 and 104 to rectangular frame 70. Bars 102 and 104 are received in brackets 106 and 108 respectively and are pivotally connected by pins 110 and 112. Pin 110 passes through bracket 106 and bar 102 while pin 112 passes through bracket 108 and bar 104. Fixed to the frame members 64 and 66 of plow 52 are similar brackets 114 and 116 which receive the opposite ends of supporting pusher bars 102 and 104 respectively. Pins 118 and 120 pass through bracket 114 and bar 102 and bracket 116 and bar 104 respectively. Thus, bars 102 and 104 are each pivotally connected at each end between rectangular frame 70 and the respective frame members 64 and 66 of plow 52. Added support is provided to bars 102 and 104, which are disposed parallel to one another, by cross bar 122 and lift bar 124 which are spaced from one another and in parallel relation to one another and fixed between pusher bars 102 and 104. Cross bar 122 and lift bar 124 add stabilizing structure to bars 102 and 104 to prevent horizontal displacement of bars 102 and 104 with respect to one another. Lift bar 124 carries brackets 126 and 128 on one side thereof which are used for pivotally supporting a lifting chain 130. Lifting chain 130 is connected pivotally to brackets 126 and 128 by pins 132 and 134 which pass through brackets 126, chain 130, and hinge 128, and chain 130 respectively.

Connected to the upper back side of rectangular plate 80 are brackets 140 and 142. Pivotally connected to brackets 140 and 142 are upper supporting pusher bars 144 and 146 respectively which are pivotally connected to brackets 140 and 142 respectively by pins 148 and 150 respectively. The forward ends of upper supporting pusher bars 144 and 146 are pivotally connected to upper frame members 60 and 62 respectively of plow 52. Bar 144 is connected to frame member 60 via a bracket 152 fixed to frame member 60, and bar 146 is pivotally connected to frame member 62 via a bracket 154 fixed to frame member 62. Pins 156 and 158 respectively pass through brackets 152 and 154 respectively to pivotally connect upper supporting pusher bars 144 and 146 to upper frame members 60 and 62 respectively of plow 52. In this preferred embodiment, bars 144 and 146 are disposed parallel to one another. In addition, all four pusher bars 102, 104, 144, and 146 are all disposed parallel to one another and are all pivotally connected at one end to the described portions connected to rectangular frame 70 and at their other ends to the described portions of the frame members of plow 52. This pivotal connection allows for the free relative vertical movement of plow 52 with respect to rectangular frame 70 while at the same time providing a very rigid and stable support for plow 52. This arrangement also controls the orientation of the plow with respect to the rectangular frame 70.

Figure 5:
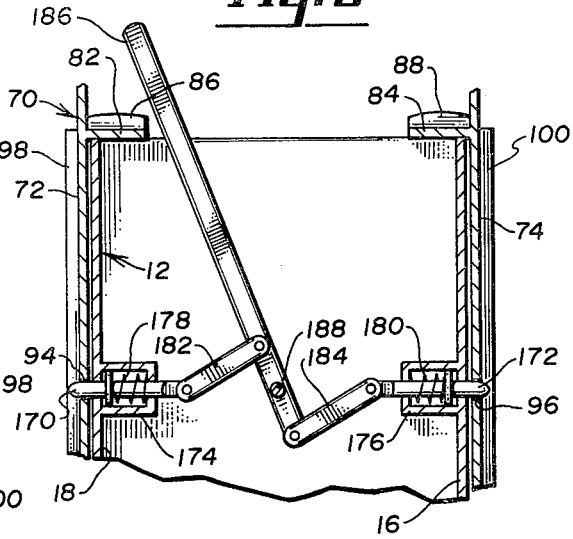
FIG. 5 is a cross-sectional view taken along lines 5—5 in FIG. 4 showing the locking mechanism for locking the two frame means together.

Frame 12, fixed to the front end 10 of the propelling vehicle, carries a locking mechanism for locking frame 12 in nestable engagement with frame 70. The locking mechanism is provided in the form of pins 170 and 172 which are housed in cylindrical housings 174 and 176 respectively. As seen in FIG. 5, within housings 174 and 176 around pins 170 and 172 are springs 178 and 180 respectively. Springs 178 and 180 allow pins 170 and 172 respectively to be appropriately biased for allowing locking nestable engagement between frame 12 and frame 70 as will be described. Pins 170 and 172 are pivotally connected via links 182 and 184 respectively to a lever arm 186. Lever arm 186 is pivotally connected by a pin 188 to portion 189 integrally formed with the cross bar portion 32 of T-bar 30. With lever arm 186 in the position shown in FIG. 1, the pins 170 and 172 are in retracted position and do not extend outwardly beyond sides 16 and 18 respectively of frame 12. In the position of lever arm 186 shown in FIG. 5, with frame 12 nesting within frame 70 in fairly tight fitting position, the pins 170 and 172 are shown in their extended position whereby the pins project through sides 16 and 18 and through openings 94 and 96 respectively of vertical sides 72 and 74 of frame 70. In this position, pins 170 and 172 serve to lock frame 12 into nestable engagement within frame 70 such that no relative horizontal or vertical motion is permitted between frames 12 and 70. The only possible motion permitted is a slight rotational motion of frames 12 and 70 relative to one another about pins 170 and 172. It should be noted that there is a relatively tight fit between frames 12 and 70 when frame 12 is in nestable engagement within frame 70.

Also carried by frame 12 is an actuating mechanism allowing lifting of the plow support frame structure 50 and accordingly plow 52. The actuating mechanism includes a conventional hydraulic cylinder 190 which is pivotally fixed at its lower end to side member 20 of frame 12 via a projection 191 fixed to a member 192 which is integrally formed with side member 20 and which is attached to the front end 10 of the propelling vehicle. Pivotally connected at the upper end of hydraulic cylinder 190 is a lifting arm or boom 194 which, at one end, 196 is fixed or secured permanently between vertical supports 34 and 36 of T-bar 30. End 198 of lifting arm 194 carries hooks 200 which are used for carrying lifting chain 130 when frame 12 and frame 70 are in locked nestable engagement with one another. Lifting arm 194 is activated by the actuating mechanism 190. Hydraulic cylinder 190 may be actuated via hoses 202 and 204 which are connected to the appropriate conventional hydraulic power supply and control mechanisms (not shown) within the vehicle for allowing the cylinder to be actuated.

Figure 3:
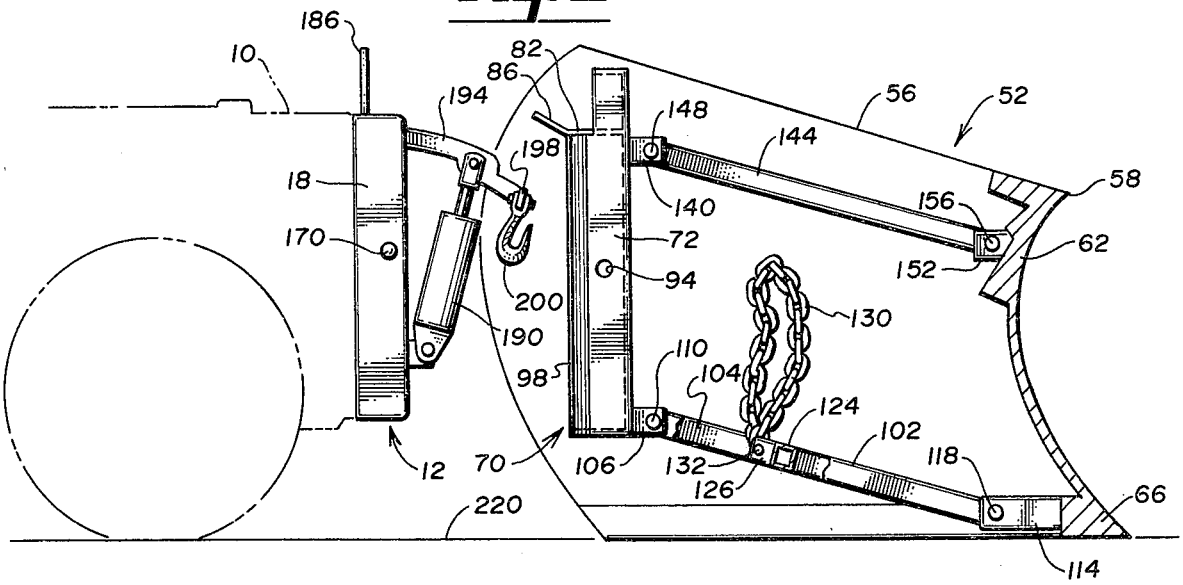
FIG. 3 is a side elevational view of the propelling vehicle (in phantom) frame means and the frame means for supporting the plow, in their unconnected position.
Figure 4:
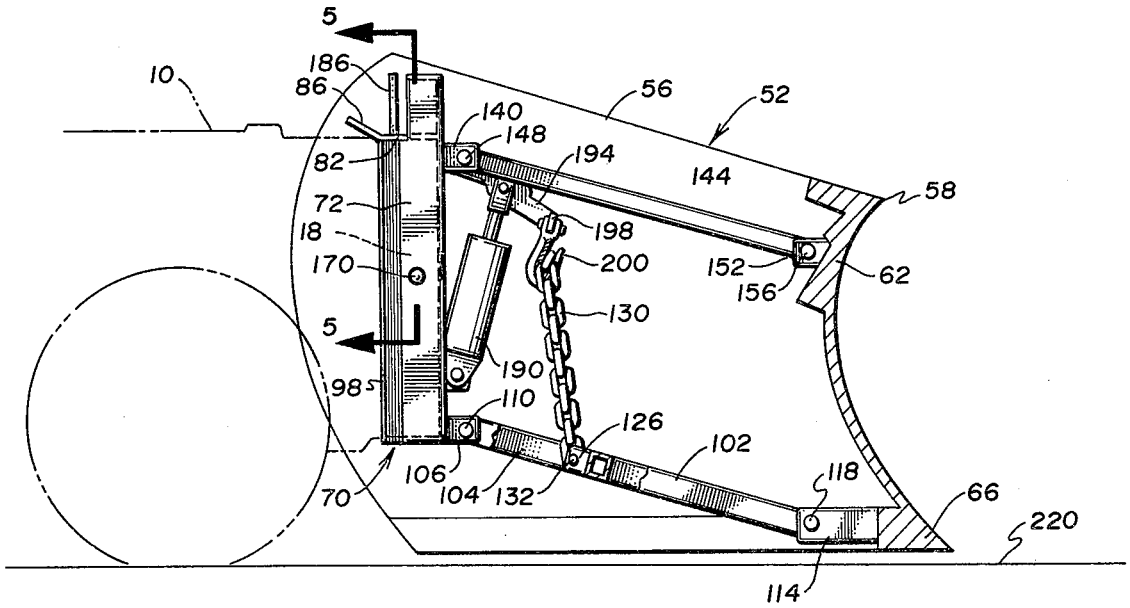
FIG. 4 is a side elevational view of the mechanism in FIG. 3 with the two frame means in locked position.

The operation of the coupling mechanism of the present invention will be described in conjunction with FIGS. 3–5. As seen in FIG. 3, as the front end 10 of the propelling vehicle approaches plow 52, frame 12 is positioned such that as it moves toward frame 70, the upwardly flared ends 86 and 88 of camming members 82 and 84 respectively engage the top portions 90 and 92 respectively of sides 18 and 16 of frame 12. As frame 12 continues to move toward frame 70, ends 86 and 88 act as a camming or guiding member so that frame 12 is brought into horizontal alignment with frame 70. The outwardly flared ends 98 and 100 of vertical sides 72 and 74 of frame 70 help guide frame 12 into correct vertical alignment with frame 12 as follows. Lever arm 186 is placed in the position shown in FIG. 5 with the pins 170 and 172 projecting out of the sides 18 and 16 respectively of frame 12. As frame 12 moves toward frame 70, pins 170 and 172 are engaged by edges 98 and 100 and are thereby deflected so as to be partially retracted within cylinders 174 and 176 respectively. This deflection and partial retraction of pins 170 and 176 provided by the outwardly flanged ends 98 and 100 of vertical sides 72 and 74 guides frame 12 into correct vertical alignment; and when frame 12 is appropriately nestably engaged within frame 70, pins 170 and 172 will snap out through openings 94 and 96 in vertical sides 72 and 74 respectively of frame 70. In this position, frame 12 will be locked in to fit fairly tightly within frame 70 and no relative motion is permitted either horizontally or vertically between frames 12 and 70. The only possible motion permitted is a slight rotational relative motion or movement of frames 12 and 70 around pins 170 and 172. Once frame 12 is nestably engaged in this locked position within frame 70, chain 130 is then placed onto hooks 200 on the end 198 of lifting arm 194. The hydraulic lift 190 may then be actuated to cause plow 52 to be raised and held above the ground or road shown at 220 a desired amount. This hydraulic lift and the chain 130 support the plow 52 at this desired distance above the road 220. As can be seen particularly in FIGS. 3 and 4, plow 52 is free to move vertically with respect to the road surface because of the pivotal connection of lower supporting pusher bars 102 and 104 to frame 70 and to the lower frame members 64 and 66 of plow 52. Likewise, the upper supporting pusher bars 144 and 146 are pivotally connected both at the upper portion of frame 70 and the upper frame member 60 and 62 respectively of plow 52. With this supporting mechanism pivotally connected at all points, with all four supporting bars 102, 104, 144, and 146 all disposed in parallel relationship to one another, it can be seen that plow 52 will float freely in a vertical direction with respect to frames 12 and 70, while the supporting structure of frames 12 and 70 (when in nestable engagement) and the manner of the pivotal connection of the supporting bars prevent any undesired horizontal movement or orientation of plow 52. Therefore, this pivotal connection structure acts to allow free vertical movement of the plow to conform to the undulations and unevenness which may be in the road surface 220 while at the same time controlling the orientation of the plow with respect to the frames 12 and 70. In this nestable engagement of frame 12 within frame 70, a very stable and unyielding supporting structure is provided for the plow while simultaneously permitting free vertical movement of the plow with minimal wear and tear of the moving parts.

A number of modifications or alternatives may be provided to the invention as described above. For example, it is possible that rather than providing two parallelly disposed upper supporting pusher bars 144 and 146, it is possible to arrange these bars so that they pivotally connect at the same point on the plow frame structure instead of being parallelly disposed to one another. In some applications, such arrangement of the upper supporting pusher bars may be desirable. But, again, such arrangement contemplates the pivotal connection of both the lower and upper pusher bars to the frame 70 as well as to the plow frame structure. In another alternative structure, it is feasible that the locking mechanism including pins 170 and 172 and the attendant structure may be mounted on frame 70 rather than frame 12; and in such arrangement, frame 70 would be slightly smaller than frame 12 and would nestably engage in and be locked within frame 12. It would also be possible to have the hydraulic cylinder and its attendant structure coupled to frame 70; and when frame 70 was brought into nestable locked engagement within frame 12, the lifting arm 194 would be connected to a chain or other supporting means connected to some portion of frame 12.

It should also be pointed out that, although the coupling mechanism of the present invention has been described with respect to a particular type of snow-plow, it may be utilized with other types of snow-plows, as well as with other implements such as a bucket, ground plow, snow blower, or other type of implement which is to be moved along a road or surface and which requires a quick coupling or hitching mechanism.

It will, of course, be understood that various changes as well as those mentioned above may be made in the form, details, arrangement, and proportions of the various parts without departing from the scope of my invention.

What I claim is:

1. An automatic coupling mechanism for snow-plow comprising:

(a) first frame means attachable to a propelling vehicle for cooperating with a plow frame structure of such a snow-plow for movement of the plow along the road;

(b) second frame means constructed and arranged to be connected to such a plow frame structure for lockably connecting with said first frame means;

(c) guide means attached to one of said frame means for guiding said first frame means into lockable relative position with said second frame means;

(d) automatic securing means carried by one of said frame means for locking said first and second frame means to one another when in such position and constructed and arranged to prevent relative horizontal and vertical motion between said first and second frame means when so connected;

(e) free-floating parallelogram pivotal support means carried by said second frame means and constructed and arranged to be pivotally connected in supporting relation between said second frame means and the plow frame structure for supporting such plow and allowing free relative vertical movement thereof with respect to said first and second frame means, and for cooperatively controlling orientation of such a plow relative to said second frame means; and (f) power lift means connected with one of said frame means and engageable with said support means.

2. An automatic coupling mechanism as set forth in claim 1 wherein:

(g) said first frame means comprises a substantially rectangular frame having its longer sides extending substantially upright with respect to the road;

(h) said second frame means comprises a substantially rectangular frame having its longer sides extending substantially upright with respect to the road; and (i) said rectangular frames being constructed and arranged so that said first and second frame means are in nestable engagement when lockably connected to one another wherein one of said rectangular frames is relatively tightly fitted within the other of said rectangular frames.

3. An automatic coupling mechanism as set forth in claim 2 wherein said pivotal support means includes:

a first pair of spaced-apart bars, each of said bars being pivotally connected at one end thereof near the lower end of a different one of the longer sides of said rectangular frame of said second frame means and pivotally connected at the other end near the lower portion of the frame structure of such a plow; and a second pair of spaced-apart bars, each of said bars being pivotally connected at one end thereof near the upper end of a different one of the longer sides of said rectangular frame of said second frame means and pivotally connected at the other end near the upper portion of the frame structure of such a plow.

4. An automatic coupling mechanism as set forth in claim 2 wherein:

said securing means comprises a pair of spring-biased pins mounted on one of said frame means and the other of said frame means having openings of greatest dimension not substantially greater than the cross-sectional dimension of said pins appropriately located such that, as said first and second frame means are guided into nestable engagement with one another, said pins will snap into firmly seated position in said openings thereby locking said frame means together so as to allow only very slightly relative rotational movement of said frame means around said pins.

5. An automatic coupling mechanism as set forth in claim 4 wherein:

said pins are carried by said rectangular frame of said first frame means;

said rectangular frame of said first frame means fits in nestable engagement within said rectangular frame of said second frame means; and said lifting means comprises an hydraulically actuated lifting mechanism mounted on said rectangular frame of said first frame means, and attachment means carried by said support means and couplable to said lifting mechanism, whereby when said first and second frame means are in locked connection and said attachment means are coupled to said lifting mechanism, said support means may be pivoted so as to raise and hold such a plow a desired amount off the road by actuating said lifting mechanism.

6. An automatic coupling mechanism as set forth in claim 1 wherein:

said guide means comprises spaced-apart camming members peripherally disposed on said second frame means extending in a direction away from such a plow such that, as said first frame means is moved toward said second frame means, said camming members engage and guide said second frame means both vertically and horizontally into the lockable connection position with said first frame means.

7. An automatic coupling mechanism for a snow-plow comprising:

(a) first nestable rectangular frame means attachable to a propelling vehicle for cooperating with a plow frame structure of such a snow-plow for movement of the plow along the road;

(b) second nestable rectangular frame means constructed and arranged to be connected to such a plow frame structure for close-fitting nesting and lockably connecting with said first frame means;

(c) guide means attached to peripheral portions of at least one of said frame means for guiding said first frame means into lockable position relative to said second frame means;

(d) automatic securing means carried by one of said frame means for locking said first and second frame means to one another when in such position and constructed and arranged to prevent relative horizontal and vertical motion between said first and second frame means when so connected; and (e) free-floating pivotal support means carried by said second frame means and constructed and arranged to be pivotally connected in supporting relation between said second frame means and the plow frame structure for supporting such plow, and allowing free relative vertical movement thereof with respect to said first and second frame means, and for cooperatively controlling orientation of such a plow relative to said second frame means.

8. An automatic coupling mechanism as set forth in claim 1 further comprising:

said lifting means carried by said first and second frame means for allowing such a plow to be raised and held above the road a desired amount.

* * * * *

UNITED STATES PATENT AND TRADEMARK OFFICE

CERTIFICATE OF CORRECTION

PATENT NO. : 4,127,951
DATED : December 5, 1978
INVENTOR(S) : Richard W. Hatch

It is certified that error appears in the above-identified patent and that said Letters Patent are hereby corrected as shown below:

Column 1, line 67, delete "witha" and insert - with -

Signed and Sealed this

Sixth Day of March 1979

[SEAL]

*Attest:*

RUTH C. MASON
*Attesting Officer*

DONALD W. BANNER
*Commissioner of Patents and Trademarks*